US007044092B2

(12) United States Patent
Panciroli

(10) Patent No.: US 7,044,092 B2
(45) Date of Patent: May 16, 2006

(54) METHOD AND DEVICE FOR CONTROLLING AN ELECTROHYDRAULIC UNIT FOR ACTUATING THE VALVES OF AN ENDOTHERMIC ENGINE

(75) Inventor: Marco Panciroli, Ravenna (IT)

(73) Assignee: Magneti Marelli Powertrain S.p.A., (IT)

( * ) Notice: Subject to any disclaimer, the term of this patent is extended or adjusted under 35 U.S.C. 154(b) by 10 days.

(21) Appl. No.: 10/873,728

(22) Filed: Jun. 22, 2004

(65) Prior Publication Data

US 2005/0022759 A1 Feb. 3, 2005

(30) Foreign Application Priority Data

Jun. 23, 2003 (IT) ..... BO2003A0388

(51) Int. Cl.
*F01L 9/04* (2006.01)

(52) U.S. Cl. ..... 123/90.12; 123/90.11; 123/90.13

(58) Field of Classification Search ..... 123/90.11, 123/90.12, 90.13, 90.15
See application file for complete search history.

(56) References Cited

U.S. PATENT DOCUMENTS 6,581,557 B1 6/2003 Gassler et al. ..... 123/90.15
6,631,699 B1 10/2003 Lutz et al. ..... 123/90.15
6,739,293 B1 * 5/2004 Turner et al. ..... 123/90.12
6,772,737 B1 8/2004 Gassler et al. ..... 123/490
6,827,050 B1 * 12/2004 Cotton, III et al. ..... 123/90.12
6,886,510 B1 * 5/2005 Sun et al. ..... 123/90.12
2002/0157650 A1 10/2002 Gassler et al. ..... 123/490

FOREIGN PATENT DOCUMENTS

DE 3 741 214 A1 6/1989
EP 0 647 770 A2 4/1995
WO 03/008794 A2 1/2003

OTHER PUBLICATIONS

European Search Report for EP 04 10 2847 (Sep. 21, 2004).

* cited by examiner

*Primary Examiner*—Thomas Denion
*Assistant Examiner*—Ching Chang
(74) *Attorney, Agent, or Firm*—Howrey LLP

(57) ABSTRACT

A method for controlling an electrohydraulic unit for actuating the valves of an endothermic engine, in which the electrohydraulic unit is provided with a hydraulic actuator for opening the respective valve with a pressurized liquid, and a spring that is antagonistic to the hydraulic actuator in order to close the valve, provides for the control of the connection time between the hydraulic actuator and a first branch containing the pressurized liquid as a function of a predetermined time characteristic of the electrohydraulic unit.

27 Claims, 5 Drawing Sheets

METHOD AND DEVICE FOR CONTROLLING AN ELECTROHYDRAULIC UNIT FOR ACTUATING THE VALVES OF AN ENDOTHERMIC ENGINE

CROSS REFERENCE TO RELATED APPLICATIONS

The present application claims priority to Italian Patent Application Ser. No. BO2003A 000388 filed Jun. 23, 2003.

FIELD OF THE INVENTION

The present invention relates to a method for controlling an electrohydraulic unit for actuating the valves of a spark-ignition engine.

DESCRIPTION OF RELATED ART

In general, the valves of a spark-ignition engine are moved mechanically by means of a camshaft. Alongside this well-established technology used in the automotive sector, alternative systems are currently in the experimental phase. In particular, the applicant is investigating an electrohydraulic unit for actuating the valves of an endothermic engine of the type described in patent application EP-1,233,152 in the name of the present applicant. The above-mentioned electrohydraulic unit is controlled by an electronic unit and makes it possible to vary the opening and closing times of each valve according to a cycle assigned as a function of the angular velocity of the crankshaft and other operating parameters of the engine, substantially increasing the efficiency of the engine.

The electrohydraulic unit currently under investigation provides, for each of the engine's intake or exhaust valves, an electrohydraulic actuating device which comprises a linear hydraulic actuator capable of displacing the valve axially from the closed position to the maximally open position, overcoming the action of a resilient element capable of holding the valve in the closed position, and a hydraulic distributor capable of controlling the flow of pressurized oil away from and towards the hydraulic actuator in such a manner as to control the displacement of the valve between the closed position and the maximally open position.

In order to meet requirements for pressurized oil, the electrohydraulic unit under investigation is provided with a hydraulic circuit that comprises an oil-holding tank, within which the oil to be delivered to the actuators is stored at ambient pressure, and a pumping unit capable of delivering the pressurized oil to the various distributors by taking it directly from the holding tank. The electrohydraulic unit described in patent application EP 1,233,152 comprises a slide valve distributor, which is capable of assuming a first operating position in which it places the hydraulic actuator in direct communication with a pressurized oil discharge tank, a second operating position in which it isolates the hydraulic actuator so as to prevent the oil from flowing away from and towards said actuator and a third operating position in which it places the linear hydraulic actuator in direct communication with a branch containing pressurized liquid for specific connection time.

The unit described has the considerable merit of having a particularly simple structure that ensures high levels of reliability over time, allowing its use in automotive applications.

However, the investigations currently under way have revealed the need to control the electrohydraulic unit in order to optimize the operation of the electrohydraulic unit itself in relation to the fact that, during the opening and closing phases, the valve exhibits a predetermined time that correlates with the oscillation of the valve and is attributable to the characteristics of the electrohydraulic unit.

SUMMARY OF THE INVENTION

The aim of the present invention is to provide a method for controlling an electrohydraulic unit for actuating the valves of an endothermic engine so as to optimize the operation of the electrohydraulic unit and the engine.

The present invention provides a method for controlling an electrohydraulic unit for actuating the valves of an endothermic engine, in which the electrohydraulic unit comprises a hydraulic actuator for opening a respective valve with a pressurized liquid, and a spring which is antagonistic to the hydraulic actuator in order to close the valve; the method being characterized in that the connection time between the hydraulic actuator and a first branch containing said pressurized liquid is controlled as a function of a predetermined time characteristic of the electrohydraulic unit.

In this manner, it is possible to select the preferred operating modes: for example, by requiring that the connection time be equal to the predetermined time characteristic of the electrohydraulic unit, considerable energy recovery is obtained whereas, when the connection time differs from the predetermined time, which is for example desired when the engine is running cold in order to adjust the liquid to temperature quickly, energy dissipation is obtained.

The present invention furthermore relates to a device for controlling an electrohydraulic unit for actuating the valves of an endothermic engine.

The present invention provides a device for controlling an electrohydraulic unit for actuating the valves of an endothermic engine, in which the electrohydraulic unit comprises a hydraulic actuator for opening a respective valve with a pressurized liquid, and a spring that is antagonistic to the hydraulic actuator in order to close the valve; the device being characterized in that it comprises control means for controlling the connection time between the hydraulic actuator and a first branch containing said pressurized liquid as a function of a predetermined time characteristic of the electrohydraulic unit.

DESCRIPTION OF THE FIGURES

The present invention will now be described with reference to the attached drawings, which illustrate some non-limiting embodiments of the invention, in which:

With reference to FIG. 1, 1 denotes the overall electrohydraulic unit for actuating the valves 2 of an endothermic engine M. FIG. 1 shows just one valve 2 coupled with a respective seat 2A, although the electrohydraulic unit 1 is capable of controlling all the intake and exhaust valves of the engine M. In the present description, "opening of the valve 2" is taken to mean the phase of changing from the closed position of the valve 2 to the maximally open position; "closure of the valve 2" is taken mean the phase of changing between the maximally open position of the valve 2 and the closed position; and "holding" is taken to mean the phase during which the valve 2 remains in the maximally open position. Consequently, in relation to the valve 2, the terms open, close and hold have an analogous meaning. The unit 1 comprises a hydraulic circuit 3 and a control device 4. In turn, the hydraulic circuit 3 comprises a circuit 5, common to all the valves 2, and a plurality of actuating devices 6, each of which is associated with a respective valve 2. For the sake of simplicity, FIG. 1 shows just one device 6 associated with the respective valve 2.

DETAILED DESCRIPTION OF THE INVENTION

Figure 1:
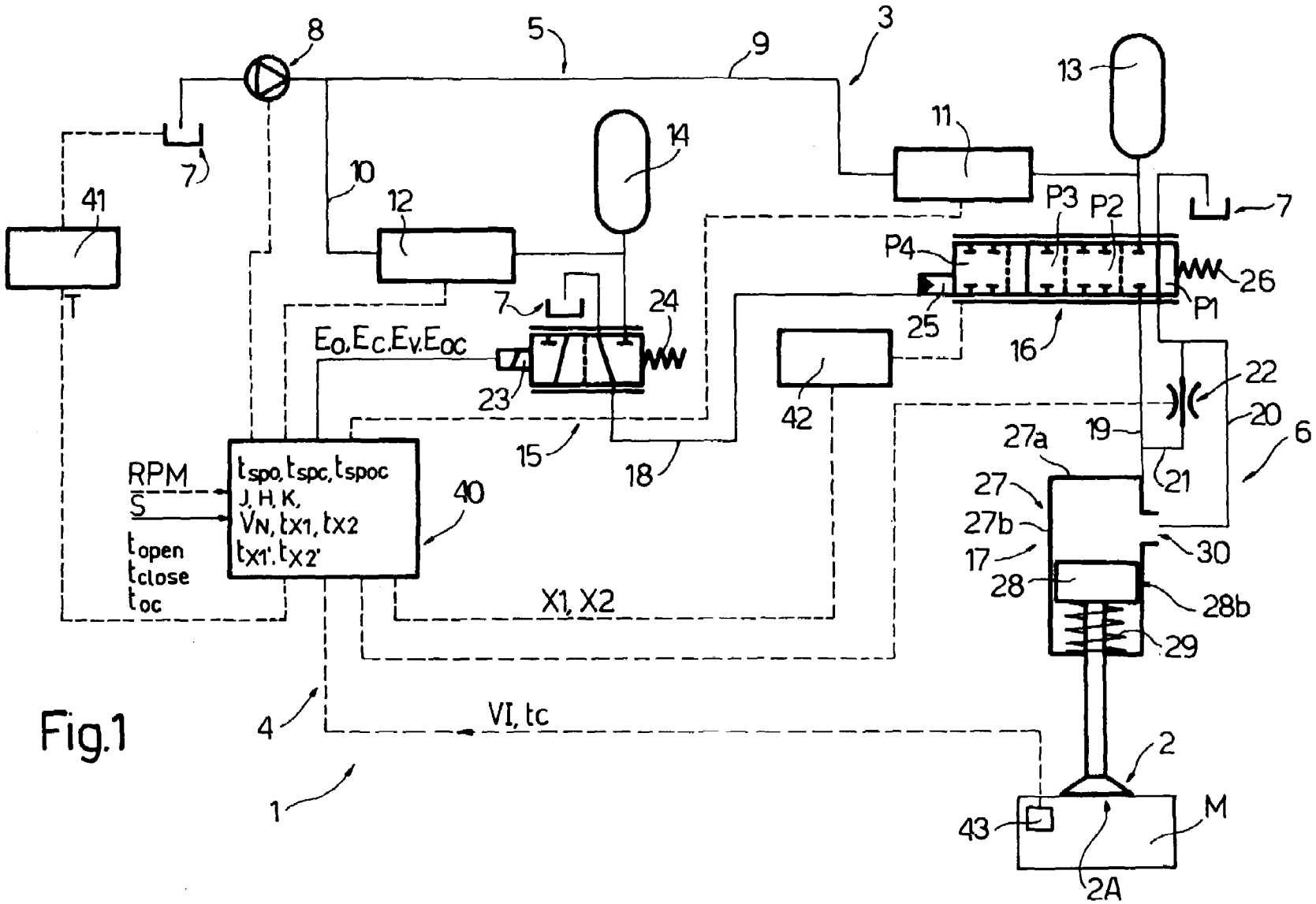
FIG. 1 is schematic view of the electrohydraulic unit for actuating the valves of a spark-ignition engine.

The circuit 5 comprises an oil holding tank 7, a pumping unit 8 and two branches 9 and 10, which are supplied with pressurized oil and along which are successively arranged respective pressure regulators 11 and 12 and respective pressure accumulators 13 and 14. The two branches 9 and 10 of the circuit 5, downstream from the respective accumulators 13 and 14, are connected to the actuating devices 6, each of which comprises a control selector 15, a slide valve distributor 16 and a hydraulic actuator 17 rigidly coupled to the valve 2. The selector 15 is connected to the branch 10, to the tank 7 and to a branch 18 that connects the selector 15 to the distributor 16 in order to control the distributor 16 itself.

The distributor 16 is connected to the branch 9, to the tank 7, to a delivery branch 19 to the actuator 17 and a discharge branch 20 from the actuator 17. The branch 19 and the branch 20 are connected by a discharge branch 21, along which an orifice 22 is provided. The discharge branch 21 and orifice 22 have the function of slowing the valve 2 in the closing phase and maintaining a constant velocity for closing the valve 2. In particular, slowing of the valve 2 takes effect during the final part of the closing stroke of the valve 2, as will be described below in greater detail in the present description.

The selector 15 is a three-way valve controlled by an electromagnet 23 and by a spring 24 and is capable of assuming two positions: when the electromagnet 23 is not excited, the spring 24 holds the selector in the first position, in which the branch 10 is closed, while the branch 18 is connected to the tank 7 (FIG. 1); when excited, the electromagnet 23 overcomes the force of the spring 24 and places the selector 15 in the second position, in which the branch 10 is connected to the branch 18.

The distributor 16 is a four-way valve controlled by a piston 25 and by a spring 26 and is capable of assuming substantially four operating positions shown diagrammatically as P1, P2, P3 and P4 in FIG. 1. While the selector 16 has four operating positions P1, P2, P3 and P4, it actually has only two stable positions, namely the end positions indicated as P1 and P4 in FIG. 1. The operating positions P2 and P3 are transitional positions between the opposing the operating positions P1 and P4. In the operating position P1, the branch 20 is connected to the tank 7, while the branch 9 and the branch 19 are disconnected; in the operating position P2, all the connections are broken; in the operating position P3, the branch 9 is connected to the branch 19, while the discharge branch 20 is shut off: for this reason, the operating position P3 is defined as the actuating position; the operating position P4 again exhibits the same features as the operating position P2.

The linear hydraulic actuator 17 comprises a cylinder 27, a piston 28 connected to the valve 2 and a spring 29 capable of holding the valve 2 in the closed position. The cylinder 27 has a head 27*a* and a jacket 27*b*, along which a side discharge opening 30 is arranged. The piston 28 comprises a crown 28*a* and a side face 28*b*, which, in specific positions of the piston 28, closes the opening 30.

Figure 7:
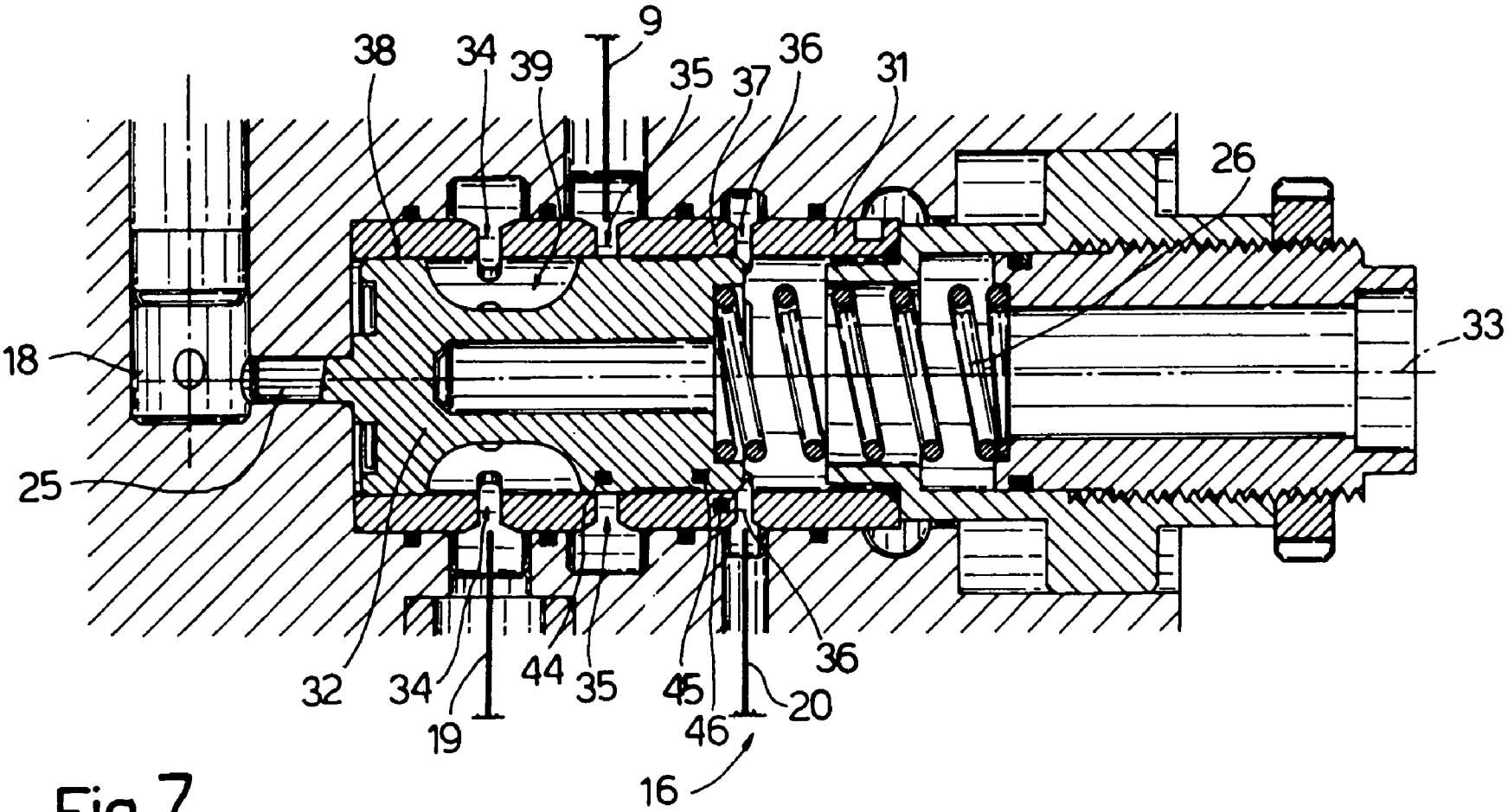
FIG. 7 is a sectional view of a component of the electrohydraulic unit of FIG. 1.

In order to understand the functioning of the unit 1 better, it is necessary to describe the distributor 16 from the structural standpoint and with reference to FIG. 7, in which some components of the unit 1 are illustrated from the structural standpoint and bear the same reference numeral as in FIG. 1. The distributor 16 comprises a sleeve 31 and a slide valve 32 that slides inside the sleeve 31 along an axis 33. The branch 19, the branch 9 and the branch 20 communicate with respective series of radial holes 34, 35 and 36 provided in the sleeve 31. The radial holes 34, 35 and 36 of each series are distributed around the axis 33, while the series of radial holes 34, 35 and 36 are distributed along the axis 33 with a spacing determined as a function of the geometric characteristics of the slide valve 32, which comprises two faces 37 and 38, which substantially slide against the sleeve 31 and are separated by a recess 39. Essentially, there is a geometric relationship between the axial extent of the faces 37 and 38 and of the recess 39 and the axial position of the axial holes 34, 35 and 36 such as to define all the operating positions P1, P2, P3 and P4 of the slide valve 32. In particular, the dimensions of the slide valve 32 and the sleeve 31 make it possible to align the recess 39 simultaneously with both series of holes 34 and 35 and to align the face 38 with the series of holes 36, so as to shut off the return branch 20 and to supply pressurized oil from the branch 9 to the branch 19. The position described corresponds to the operating position P3 of FIG. 1 and is not actually a stable position of the slide valve 32: the open cross-section or port available to the oil for passage from the branch 9 to the branch 19 varies as a function of the position of the slide valve 32.

The control device 4 comprises an electronic control unit 40, which, on the basis of data captured from the engine M, such as for example rotational speed RPM and other operating parameters, determines the opening time and closing time for each valve 2. The unit 40 thus controls the electromagnet 23 in order to actuate in cascade the selector 15 of the distributor 16 and the linear actuator 17. The control device 4 furthermore comprises a sensor 41 for the temperature T of the oil; a sensor 42 for the position of the distributor 16 and a sensor 43 for the impact velocity of the valve 2.

With reference to FIG. 7, the position sensor 42 comprises two permanent magnets 44 and 45, which are embedded in the sliding component 32 and are arranged at a distance from one another along the axis 33 that is equal to the difference between the strokes of the slide valve 32 required respectively to open and close the holes 35 and 34. The sensor 42 comprises a detector 46 arranged along the sleeve 31 in order to detect the opening of the hole 35 and the closure of the hole 34 in the stroke moving from left to right in FIG. 7 and vice versa in the stroke moving from right to left. The geometry of the distributor 16 ensures that the connection between the branch 9 and the branch 19 begins after the slide valve 32 has been displaced by a first amount and is brought to an end after the slide valve 32 has been displaced by a second amount. In this manner, the detector 46 detects the passage of the magnet 45 (first amount of displacement), which corresponds to the opening of the open cross-section, and the passage of the magnet 44, which corresponds to the closure of the open cross-section during displacement from P1 to P4. The order of detection is reversed on a return displacement from P4 to P1. Essentially, with two thresholds 44 and 45 and a single detector 46, it is possible to identify the opening and closing positions of the open cross-section due to the displacement of the slide valve 32 in both directions.

The sensor 43 takes the form of an accelerometer which detects the impact that occurs when the valve 2 comes back into contact with the respective seat 2A. The sensor 43 can also be a detonation sensor, the signal from which, when detected and filtered, is correlated with the impact velocity $V_I$ for each valve 2. Thus, by means of a single accelerometer fitted on the engine M, it is possible to detect the impact velocity for each valve 2 of the engine M.

The unit 40, besides controlling the electromagnet 23, also controls the pressure regulators 11 and 12 and the open cross-section of the variable cross-section orifice 22.

Figure 2:
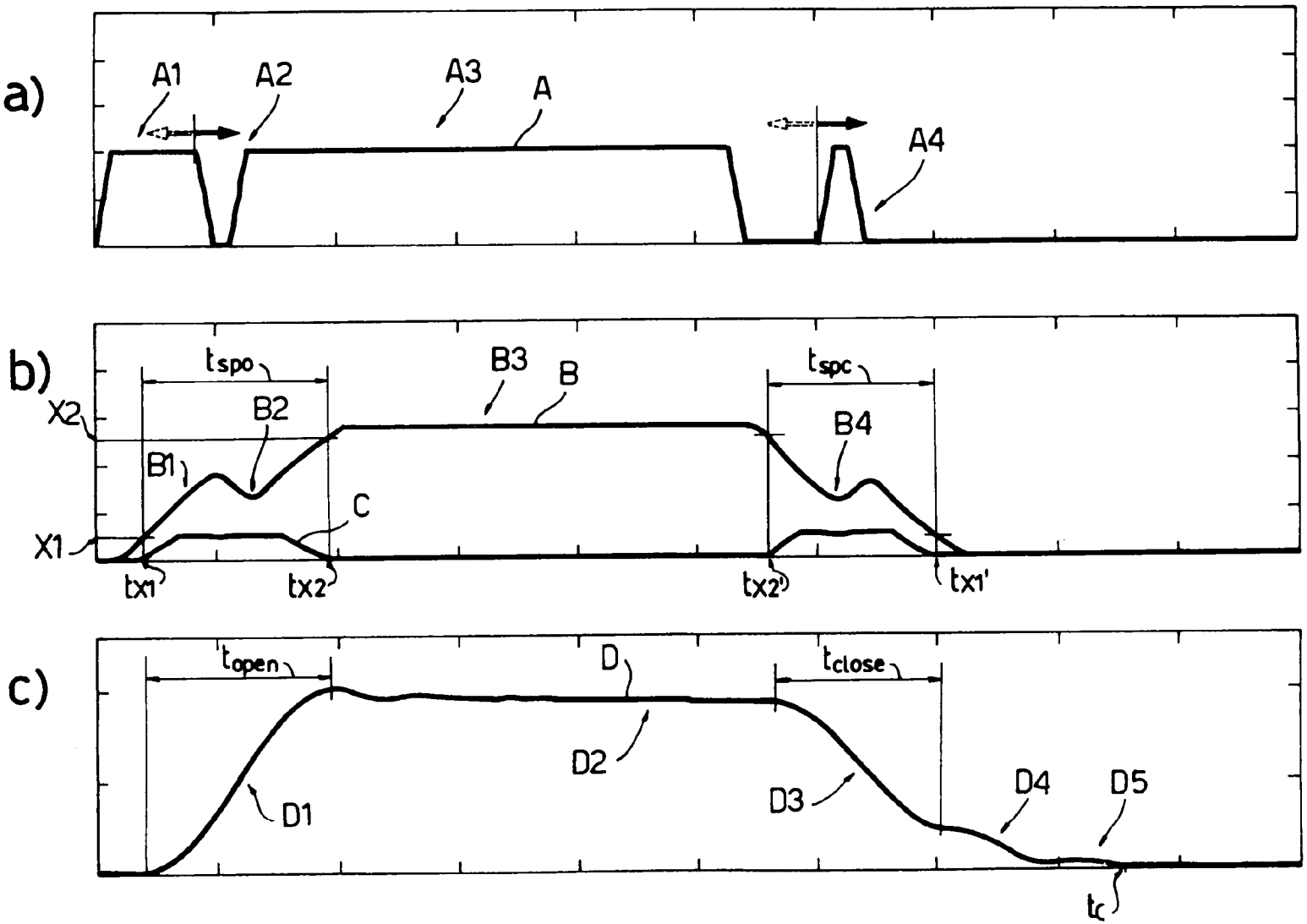
FIG. 2 is a diagram relating to a sequence of positions of some components of the electrohydraulic unit of FIG. 1 in accordance with a first operating mode.

In service, movement of the valve 2 proceeds in accordance with the diagram shown in FIG. 2, part a) of which shows the curve A, which indicates the displacement (y-coordinates) of the selector 15 as a function of time (x-coordinates); part b) shows the curve B, which indicates the position (y-coordinates) of the distributor 16 and the curve C which indicates the open cross-section or port (y-coordinates) connecting the branch 9 and the branch 19 as a function of time (x-coordinates); and part c) shows the curve D, which indicates the position (y-coordinates) of the valve 2 as a function of time (x-coordinates). Parts a), b) and c) are aligned in such a manner that their respective time scales are in phase throughout parts a), b) and c). In this manner, it is possible to compare the relationships between the positions of the selector 15, the distributor 16, the effect of the position of the distributor 16 on the open cross-section, and the position of the valve 2.

The principle of operation is based on the fact that the unit 40 excites the electromagnet 23 according to a cycle assigned as a function of engine status: namely operating parameters such as torque, rotational speed or emissions. With reference to FIG. 2 *c*), the valve 2 has a predetermined time $t_{open}$ that is necessary to open the valve 2 and a predetermined time $t_{close}$ that is necessary to close the valve 2, at least in part, which times are substantially constant and are determined by the equivalent mass and rigidity of the system, the system being taken to comprise the assembly formed by the piston 28, the valve 2, the spring 29 and the oil contained in the cylinder 27. The times $t_{open}$ and $t_{close}$ are influenced by the characteristics of the oil and are obtained experimentally. In order to obtain the required trajectory of the valve 2 while simultaneously minimizing energy losses, the opening time of the open cross-section must correspond to $t_{open}$ during the opening phase of the valve 2 and to the time $t_{close}$ during the closing phase of the valve 2. Essentially, the times $t_{open}$ and $t_{close}$ are substantially equal to half the first oscillation period of a system defined by the valve 2, the piston 28, the spring 29 and the oil.

However, as previously mentioned, the operating position P3 of the distributor 16 is not a stable position and, therefore, without detecting the position of the slide valve 32, it is not possible to detect the opening time of the open cross-section. In practice, as shown in FIG. 2 b), the sensor 42 detects two points X1 and X2 of the curve B in order to determine the curve C of the open cross-section. In practice, the unit 40 detects the times $t_{X1}$ and $t_{X2}$ and calculates the time $t_{spo}$, which is equal to the difference between $t_{X2}$ and $t_{X1}$, and represents the time that elapses between the detection of the two points X1 and X2: the time $t_{spo}$ accordingly corresponds to the opening time of the open cross-section during the opening phase of the valve 2 and can be defined as the actuation time of the actuator 17 during the opening phase of the valve 2. Similarly, the unit 40 calculates the time $t_{spc}$ which elapses between the detection of the two points X2 and X1: the time $t_{spc}$ is equal to the difference between the times $t_{X1}$ and $t_{X2}$, and corresponds to the opening time of the open cross-section during the closing phase of the valve 2, which can be defined as the actuation time of the actuator 17 during the closing phase of the valve 2. The unit 40 subsequently calculates the respective differences between the values for $t_{spo}$ and $t_{spc}$ and the values for $t_{open}$ and $t_{close}$ and outputs respective error signals $E_o$ and $E_c$ when the calculated differences exceed defined threshold values H and K.

With reference to FIG. 1, in the absence of error signals $E_o$, $E_c$, the selector 15 operates according to a cycle in which change from the position shown in FIG. 1 to the position in which the branches 10 and 18 are connected defines the opening of the valve 2, holding of the connection between the branches 10 and 18 defines the valve 2 being held in the open position and breaking of the connection between the branches 10 and 18 defines the closure of the valve 2.

With reference to FIG. 2, the unit 40 displaces the selector 15 (portion A1 of the curve A), in order to open the valve (portion B1 of the curve B of the distributor 16 and portions D1 of the curve D of the valve 2). Subsequently, in the presence of an error signal $E_o$, the unit 40 displaces the selector 15 (portion A2 of the curve A) in order to break the connection between the branches 10 and 18 temporarily during the opening phase of the valve 2 after the point X1 has been detected and before the point X2 has been detected in order to delay the closure of the open port and to synchronize the time $t_{spo}$ with the time $t_{open}$. The distributor 16 oscillates (portion B2 of the curve B) in the connection position between the branches 9 and 19.

While the valve 2 (portion D2 of the curve D, FIG. 2 *c*)) is being held in the open position, the selector 15 remains in the connection position between the branches 10 and 18 (portion A3 of the curve A of the curve 2*a*)), such that the distributor 16 is arranged in the operating position P4 (portion B3 of the curve B, FIG. 2 *b*)).

The breaking of the connection between the branches 10 and 18 defines the beginning of closure of the valve 2 (portion D3 of the curve D).

In the presence of error signal $E_c$, the unit 40 temporarily connects the branch 10 to the branch 18 (portion A4 of the curve A, FIG. 2 *a*) during the closing phase of the valve 2 after the point X2 has been detected and before the point X1 has been detected in order to delay the closure of the open port. The distributor 16 oscillates during the closing phase in a position of connection between the branches 9 and 19.

In the example described above and shown diagrammatically in FIG. 2, the selector 15 is actuated after $t_{X1}$ has been detected in order to cut off the branches 10 and 18 temporarily and to vary the connection time $t_{spo}$ during the opening phase. However, such a temporary cut-off can be performed before the moment $t_{X1}$ in order to achieve the same aim.

In each cycle, the unit 40 calculates the error signals $E_o$ and $E_c$ and optionally controls the times $T_{spo}$ and $T_{spc}$ in the above-described manner in the subsequent cycle, adjusting the displacement of the distributor 16 as a function of the times $t_{open}$ and $t_{close}$.

When reference is made in the above description to a closed-loop operating mode, it should be understood that the system is also capable of operating in open-loop mode according to a predetermined cycle that provides for the position of the selector 15 to be varied in order to control the connection times $t_{spo}$ and $t_{spc}$.

In order to understand the dynamic behavior of the unit 1, it is necessary to explain that during the opening of the valve 2, the assembly formed by the actuator 17, in the present case the piston 28 and the valve 2, performs, over the predetermined time $t_{open}$, a larger stroke than that necessary to define a balance between the force of the spring 29 and the oil pressure in the branch 9 of the circuit 3. This is attributable to the dynamic behavior of the system comprising piston 28, valve 2, spring 29 and oil, which is subject to a first oscillation with a specific period, characteristic of the particular system. Since, during the opening phase of the valve 2, the connection between the branch 9 and the branch 19 is closed and the branch 20 is shut off at the maximum oscillation amplitude, the time required to establish a balance between the force of the spring 29 and the force of the pressure in the branch 9 is not available. In fact, the spring 29, having been dynamically compressed under the inertial thrust of the system, brings about a pressure in the closed cylinder 27 that is greater than that in the branch 9. Consequently, during the closing phase of the valve 2, when the branches 9 and 19 are interconnected, some of the oil contained in the cylinder 27 flows back through the branch 19 to the branch 9. Essentially, the branch 19 performs not only the function of a delivery branch, but also that of a return branch. The phase of expelling the oil from the actuator 17 through the branch 9 is completed within the time $t_{close}$, which is substantially equal to half the oscillation period of the system. Obviously, friction means that recovery is incomplete and that the valve 2 is not completely closed at the end of said phase, but occupies an intermediate position between the maximally open position and the closed position.

Subsequently, the distributor 16 reaches the operating position P1, in which the oil contained in the cylinder 27 is initially discharged through the opening 30 and the branch 20 (portion D4 of the curve D, FIG. 2 *c*)). Displacement of the piston 28 during discharge of the oil to the tank 7 brings about progressive closure of the opening 30 and thus the residual oil contained in the cylinder 27 is discharged through the discharge branch 21 and the orifice 22 (portion D5 of the curve D, FIG. 2 *b*)). The orifice 22 has the function of slowing the closure of the valve 2 and maintaining a substantially constant closing velocity. The unit 40 is capable of varying the open cross-section of the orifice 22 so as to control the closing velocity.

Figure 3:
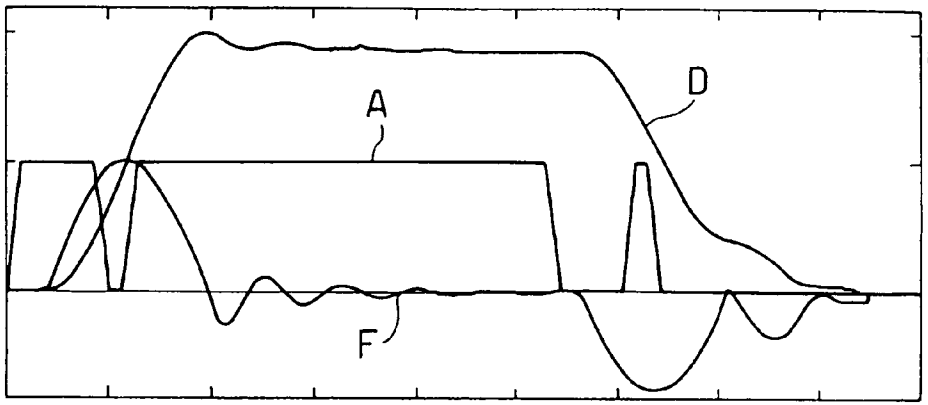
FIGS. 3 and 4 are diagrams relating to a sequence of positions of some components of the electrohydraulic unit of FIG. 1 and of velocities assumed by the valve.
Figure 5:
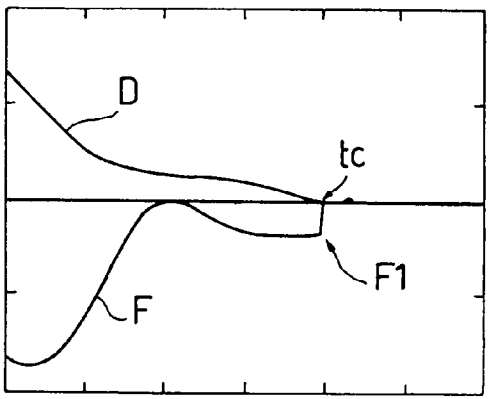
FIGS. 5 and 6 are magnified portions respectively of the diagrams of FIGS. 3 and 4.
Figure 4:
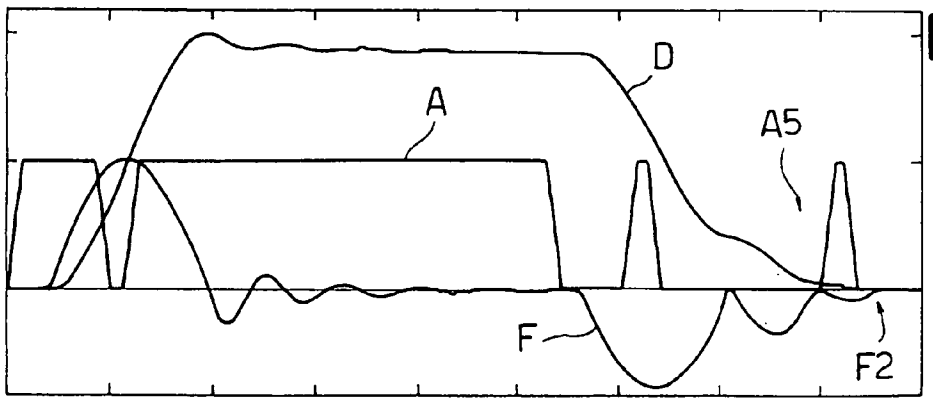
Figure 6:
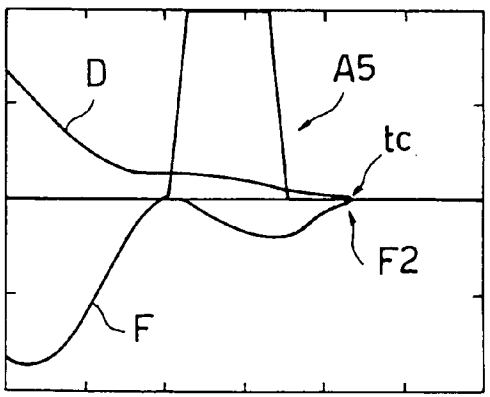

With reference to FIG. 3, as well as the curve D relating to the displacement of the valve 2 and the curve A relating to the displacement of the selector 15, the curve F is shown relating to the velocity of the valve 2. With reference to FIG. 5, the final portion F1 of the curve F comprises a substantially horizontal portion indicating the constant velocity (approx. 0.35 m/s) and a substantially vertical portion that indicates the impact (abrupt deceleration). With reference to FIG. 4, the selector 15 is activated for a moment during the approach phase of the valve 2 in such a manner as to modify the final portion F2 of the curve F. This has the effect of reducing the velocity to approx. 0.05 m/s in order to reduce the impact.

From a functional standpoint, the sensor 43 detects the impact velocity $V_I$ and the moment $t_c$ at which the valve 2 is closed in its respective seat 2A. The unit 40 captures the value of the impact velocity $V_I$ and calculates the nominal impact velocity $V_N$, which is a function of the rotational speed RPM of the engine M: at low rotational speeds RPM, low impact velocities $V_I$ are preferable, while at high rotational speeds, higher impact velocities $V_I$ can be tolerated. The control unit 40 calculates the difference between the impact velocity $V_I$ and the nominal velocity $V_N$. When said difference is greater than a predetermined threshold value S, the unit 40 calculates and outputs an error signal $E_V$ and actuates the electromagnet 23 for a short moment during the final closure phase of the valve 2 in order to displace the distributor 16 from the operating position P1 and to cut off discharge from the cylinder 27. In some cases, it could be necessary not only to cut off discharge, but even to deliver pressurized oil into the actuator 17 during the discharge phase in order to achieve more consistent deceleration. The pulse is delivered immediately before the moment $t_c$ detected in the preceding cycle.

Essentially, control of the electromagnet 23 permits two main adjustments: synchronization of the motion of the slide valve 32 with the motion of the valve 2: namely synchronization of the connection times $t_{spo}$ and $t_{spc}$ between the branches 9 and 19 with the times $t_{open}$ and $t_{close}$ characteristic of the opening and closure of the valve 2 in order to effect efficient opening and closure of the valve 2 and energy recovery and deceleration of the closing velocity of the valve 2 in order to minimize the impact velocity $V_I$ of the valve 2. In addition to these adjustments, there is also the fact that, under certain operating conditions, for example at low temperature, it is preferable to operate dissipatively rather than with energy recovery. Energy recovery is achieved by requiring that the connection times $t_{spo}$ and $t_{spc}$ substantially correspond to the predetermined times $t_{open}$ and $t_{close}$. In contrast, dissipative operation is implemented by requiring that the connection times $t_{spo}$ and $t_{spc}$ differ substantially from the predetermined times $t_{open}$ and $t_{close}$.

To this end, the sensor 41 detects the oil temperature T and the unit 40 calculates the threshold values K and H as a function of the temperature T: the values of K and H will be closer to zero, the higher is the oil temperature T. In this manner, operation with energy recovery and operation with energy dissipation as a function of oil temperature T are implemented using the same control cycle.

Figure 8:
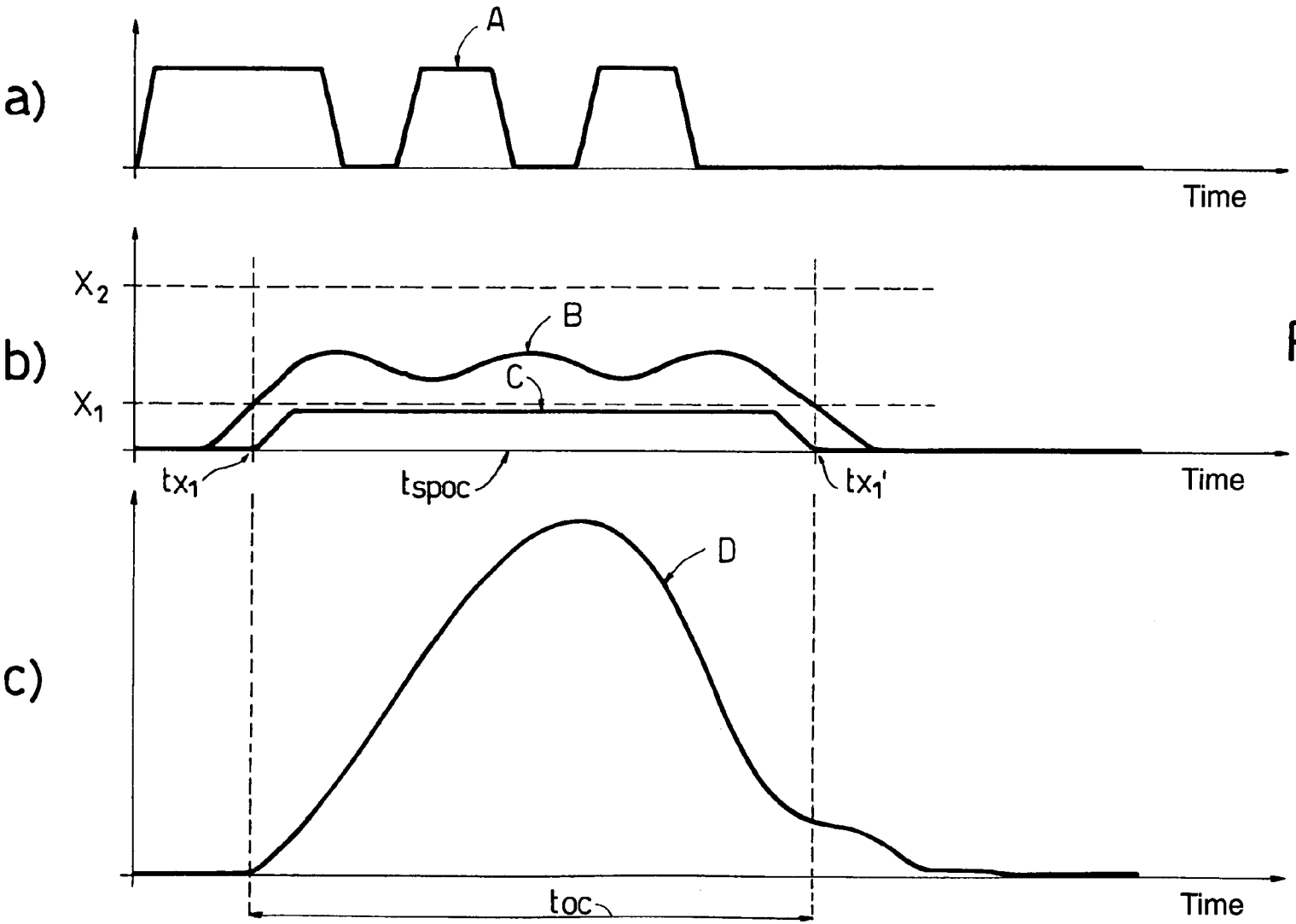
FIG. 8 is a diagram relating to a sequence of positions of some components of the electrohydraulic unit of FIG. 1 in accordance with a second operating mode.

With reference to FIG. 8, an operating mode is shown in which the distributor 16 occupies only the operating positions P1 and P2 during a cycle of the valve 2. Essentially, by controlling the selector 15, it is possible to achieve limited displacement of the distributor 16 so as to keep the distributor 16 in the position P2. In practice, the control unit 40 captures the moment $t_{X1}$ and subsequently controls the selector 15 so as to avoid exceeding the point X2 and, subsequently, detects the moment $t_{X1'}$ which corresponds to the closing time of the connection between the branch 9 and the hydraulic actuator 17. The unit 40 calculates the connection time $t_{spoc}$ as the difference between the times tx1' and tx1 and compares the time $t_{spoc}$ with a predetermined time $t_{oc}$ characteristic of the system as defined above: in this case, $t_{oc}$ takes account of the opening and partial closure phase of the valve 2 and is substantially equal to the previously defined oscillation period of the system. When the difference between the connection time $t_{spoc}$ and the predetermined time $t_{oc}$ exceeds a threshold value J, the unit 40 outputs an error signal $E_{oc}$, which is used in the subsequent cycle to control the selector 15 and to correct the time $t_{spoc}$.

The threshold value J is also a function of the oil temperature T, as described above in relation to the threshold values H and K so as to achieve operation with energy recovery and dissipative operation. Moreover, in this case too, it is possible to operate in both closed-loop and open-loop mode.

Further functions of the control unit 40 include regulating the pressure in the branch 9 by means of the pressure regulator 11 and so varying the maximum opening of the valve 2, and regulating the pressure in the branch 10 by means of the pressure regulator 12 and varying the control pressure of the distributor 16 and obtaining different dynamic behavior of the distributor 16.

The present description has made specific reference to oil as the liquid used in the hydraulic system, but it is understood that oil can be replaced with any other liquid without consequently extending beyond the scope of protection of the present invention.

What is claimed is:

1. A method for controlling an electrohydraulic unit (1) for actuating the valves (2) of an endothermic engine (M), in which the electrohydraulic unit (1) comprises a hydraulic actuator (17) for opening a respective valve (2) with a pressurized liquid, and a spring (29) that is antagonistic to the hydraulic actuator (17) in order to close the valve (2); wherein the connection time ($t_{spo}$; $t_{spc}$; $t_{spoc}$) between the hydraulic actuator (17) and a first branch (9) containing said pressurized liquid is controlled as a function of a predetermined time ($t_{open}$ $t_{close}$; $t_{oc}$) characteristic of the electrohydraulic unit: said connection time ($t_{spo}$; $t_{spc}$; $t_{spoc}$) being defined and compared with said predetermined time ($t_{open}$ $t_{close}$; $t_{oc}$); an error signal—$E_o$; $E_c$; $E_{oc}$) being output when the difference between the predetermined time ($t_{open}$ $t_{close}$; $t_{oc}$) exceeds a defined threshold (K; H; J).

2. The method of claim 1, characterized in that said predetermined time ($t_{open}$; $t_{close}$; $t_{oc}$) characteristic of the electrohydraulic unit (1) is correlated with the dynamic behavior of a system comprising said hydraulic actuator (17), the valve (2), the spring (29) and the liquid.

3. The method of claim 1, characterized in that a phase of controlling said connection time ($t_{spo}$; $t_{spc}$; $t_{spoc}$) provides for the requirement that said connection time ($t_{spo}$; $t_{spc}$; $t_{spoc}$) is substantially equal to the predetermined time ($t_{open}$; $t_{close}$; $t_{oc}$).

4. The method of claim 1, characterized in that a phase of controlling said connection time ($t_{spo}$; $t_{spc}$; $t_{spoc}$) provides for the requirement that said connection time ($t_{spo}$; $t_{spc}$; $t_{spoc}$) differs substantially from the predetermined time ($t_{open}$; $t_{close}$; $t_{oc}$).

5. The method of claim 1, characterized in that the electrohydraulic unit (1) comprises a distributor (16) for controlling the hydraulic actuator (17), said first branch (9), which connects the distributor (16) to a pumping unit (8) for a pressurized liquid, a second branch (19), which connects the distributor (16) to the hydraulic actuator (17); said distributor (16) being capable of connecting the first and second branches (9, 19); said connection time ($t_{spo}$; $t_{spc}$; $t_{spoc}$) corresponding to the connection time between the first branch (9) and the second branch (19).

6. The method of claim 5, characterized in that said distributor (16) is controlled by a hydraulic selector (15) that can move between two positions; the method providing that the distributor (16) is controlled by means of the hydraulic selector (15) in order to control the connection time ($t_{spo}$; $t_{spo}$; $t_{spoc}$).

7. The method of claim 1, characterized in that a distributor (16) is controlled as a function of said error signal ($E_o$, $E_c$, $E_{oc}$).

8. The method of claim 1, characterized in that a phase of defining said connection time ($t_{spo}$; $t_{spc}$; $t_{spoc}$) provides for the capture of a first moment ($t_{x1}$; $t_{x2'}$; $t_{x1}$), at which the connection between the first and a second branches (9, 19) is made, and a second moment ($t_{x2}$; $t_{x1'}$; $t_{x1'}$) at which the connection between the first and the second branches (9, 19) is broken.

9. The method of claim 8, characterized in that a distributor (16) comprises a slide valve (32) that slides within a sleeve (31) connected to the first and second branches (9, 19); the method providing for the detection of a first position (X1; X2; X1) of the slide valve (32) corresponding to the start of the connection and a second position (X2; X1; X1) corresponding to the end of the connection and the capture of said first moment ($t_{x1}$; $t_{x2'}$; $t_{x1}$) and said second moment ($t_{x2}$; $t_{x1'}$; $t_{x1'}$).

10. The method of claim 1, characterized in that said threshold (K; H; J) is a function of operating parameters of the electrohydraulic unit (1).

11. The method of claim 10, characterized in that said threshold (H; K; J) is a function of the temperature (T) of the liquid.

12. The method of claim 10, in which the maximally open position of the valve (2) is a function of the pressure of said liquid; the method providing that the pressure of said liquid is varied to modify the maximally open position of the valve (2).

13. The method of claim 1, characterized in that said predetermined time ($t_{open}$) is equal to the opening time of the valve (2) between the closed position and the maximally open position; said predetermined time ($t_{open}$) being a function of the mass and rigidity of the system comprising hydraulic actuator (17), valve (2) and spring (29) and the liquid and being substantially equal to half the oscillation period of said system.

14. The method of claim 1, characterized in that said predetermined time ($t_{close}$) is equal to a partial closure time of the valve (2) between the maximally open position and an intermediate position between the maximally open position and the closed position; said predetermined time ($t_{close}$) being a function of the mass and rigidity of the system comprising hydraulic actuator (17), valve (2) and spring (29) and the liquid, and being substantially equal to half the oscillation period of said system.

15. The method of claim 1, characterized in that said predetermined time ($t_{oc}$) is equal to an opening and partial closure time of the valve (2) over a cycle comprising an initial closed position, a maximally open position and an intermediate position between the closed and maximally open positions; said predetermined time ($t_{oc}$) being a function of the mass and rigidity of the system comprising hydraulic actuator (17), valve (2) and spring (29) and the liquid, and being substantially equal to the oscillation period of the system.

16. A device for controlling an electrohydraulic unit (1) for actuating the valves (2) of an endothermic engine (M), in which the electrohydraulic unit (1) comprises a hydraulic actuator (17) for opening a respective valve (2) with a pressurized liquid, and a spring (29) that is antagonistic to the hydraulic actuator (17) in order to close the valve (2); the device comprises control means (40, 15, 16) for controlling the connection time ($t_{spo}$; $t_{spc}$; $t_{spoc}$) between the hydraulic actuator (17) and a first branch (9) containing said pressurized liquid as a function of a predetermined time ($t_{open}$; $t_{close}$; $t_{oc}$) characteristic of the electrohydraulic unit (1) and means (40, 42) for capturing said connection time ($t_{spo}$; $t_{spc}$; $t_{spoc}$); a first moment ($t_{x1}$; $t_{x2'}$; $t_{x1}$) at which the connection between the first and second branches (9, 19) is made and a second moment ($t_{x2}$; $t_{x1'}$; $t_{x1'}$) at which the connection between the first and second branches (9, 19) is broken: a distributor (16) comprising a slide valve (32) that slides within a sleeve (31) connected to the first and second branches (9, 19); the device comprising means for capturing (40, 42) a first position (X1; X2; X1) of the slide valve (32) corresponding to the start of the connection and a second position (X2; X1; X1) corresponding to the end of the connection and said first moment ($t_{x1}$; $t_{x2'}$; $t_{x1}$) and said second moment ($t_{x2}$; $t_{x1'}$; $t_{x1'}$).

17. The device of claim 16, characterized in that said predetermined time ($t_{open}$; $t_{close}$; $t_{oc}$) characteristic of the electrohydraulic unit is correlated with the dynamic behavior of a system comprising said hydraulic actuator (17), the valve (2), the spring (29) and the liquid.

18. The device of claim 16, characterized in that the electrohydraulic unit (1) comprises a distributor (16) for controlling the hydraulic actuator (17), said first branch (9), which connects the distributor (16) to a pumping unit (8) for a pressurized liquid, a second branch (19), which connects the distributor (16) to the hydraulic actuator (17); said distributor (16) being capable of connecting the first and the second branches (9, 19); said connection time ($t_{spo}$; $t_{spc}$; $t_{spoc}$) corresponding to the connection time between the first branch (9) and the second branch (19).

19. The device of claim 18, characterized in that it comprises a hydraulic selector (15) for controlling said distributor (16) as a function of the connection time ($t_{spo}$; $t_{spc}$; $t_{spoc}$).

20. The device of claim 6, characterized in that it comprises means for comparing (40) the connection time ($t_{spo}$; $t_{spc}$; $t_{spoc}$) with said predetermined time ($t_{open}$; $t_{close}$; $t_{oc}$); and means for outputting (40) an error signal ($E_o$; $E_c$; $E_{oc}$) when the difference between the predetermined time ($t_{open}$; $t_{close}$; $t_{oc}$) and the connection time ($t_{spo}$; $t_{spc}$; $t_{spoc}$) exceeds a defined threshold (K; H; J).

21. The device of claim 16, characterized in that the capture means (40, 42) comprise a threshold sensor (42).

22. The device of claim 21, characterized in that said threshold sensor (42) comprises two thresholds (44, 45) fitted on the slide valve (32) and a fixed detector (46).

23. The device of claim 22, characterized in that said thresholds (44, 45) are permanent magnets.

24. The device of claim 16, characterized in that said predetermined time ($t_{open}$) is equal to the opening time of the valve (2) between the closed position and the maximally open position; said predetermined time ($t_{open}$) being a function of the mass and rigidity of the system comprising hydraulic actuator (17), valve (2) and spring (29) and the liquid, and being substantially equal to half the oscillation period of said system.

25. The device of claim 24, in which the maximally open position of the valve (2) is a function of the pressure of said liquid; the device being characterized in that it comprises a pressure regulator (11) for varying the pressure of said liquid and modifying the maximally open position of the valve (2).

26. The device of claim 16, characterized in that said predetermined time ($t_{close}$) is equal to a partial closure time of the valve (2) between the maximally open position and an intermediate position between the maximally open and closed positions; said predetermined time ($t_{close}$) being a function of the mass and rigidity of the system comprising hydraulic actuator (17), valve (2) and spring (29) and the liquid and being substantially equal to half the oscillation period of said system.

27. The device of claim 16, characterized in that said predetermined time ($t_{oc}$) is equal to an opening and partial closure time of the valve (2) over a cycle comprising an initial closed position, a maximally open position and an intermediate position between the closed and maximally open positions; said predetermined time ($t_{oc}$) being a function of the mass and rigidity of the system comprising hydraulic actuator (17), valve (2) and spring (29) and the liquid, and being substantially equal to the oscillation period of the system.

* * * * *